US005701962A

United States Patent [19]

Jantunen

[11] Patent Number: 5,701,962

[45] Date of Patent: Dec. 30, 1997

[54] ARRANGEMENT FOR CONTROLLING THE FEED MECHANISM OF A ROCK DRILL

[75] Inventor: Heikki Jantunen, Tampere, Finland

[73] Assignee: Tamrock Oy, Tampere, Finland

[21] Appl. No.: 615,300

[22] PCT Filed: Sep. 14, 1994

[86] PCT No.: PCT/FI94/00404

§ 371 Date: Mar. 18, 1996

§ 102(e) Date: Mar. 18, 1996

[87] PCT Pub. No.: WO95/08693

PCT Pub. Date: Mar. 30, 1995

[30] Foreign Application Priority Data

Sep. 20, 1993 [FI] Finland ..... 934111

[51] Int. Cl.[6] ..... E21B 3/02; E21B 7/02

[52] U.S. Cl. ..... 175/24; 173/6; 175/122

[58] Field of Search ..... 175/24, 27, 122; 173/6, 11

[56] References Cited

U.S. PATENT DOCUMENTS

| | | | |
|---|---|---|---|
| 3,561,542 | 2/1971 | Hanson | 173/1 |
| 3,807,510 | 4/1974 | Boom et al. | 173/160 |
| 4,074,771 | 2/1978 | Morrison | 173/6 |

FOREIGN PATENT DOCUMENTS

| | | |
|---|---|---|
| 43976 | 8/1971 | Finland . |
| 78159 | 2/1989 | Finland . |
| 32 46 591 A1 | 6/1984 | Germany . |
| 1066425 | 4/1967 | United Kingdom . |

*Primary Examiner*—Hoang C. Dang

*Attorney, Agent, or Firm*—Nixon & Vanderhyde P.C.

[57] ABSTRACT

An arrangement for controlling the feed motion of the feed beam of a rock drill, the arrangement including sensing elements for detecting the position of the front and for rear end of the rock drill and for controlling the feed and the return motion. In the arrangement of the invention, inductive sensors are mounted in the middle of the feed beam, and indicators are secured to the cylinder sleeve of the feed cylinder so that the position of the cylinder sleeve indicates the position of the front and the rear end of the drill and thus controls the feed motion of the drill.

5 Claims, 2 Drawing Sheets

Figure 1:
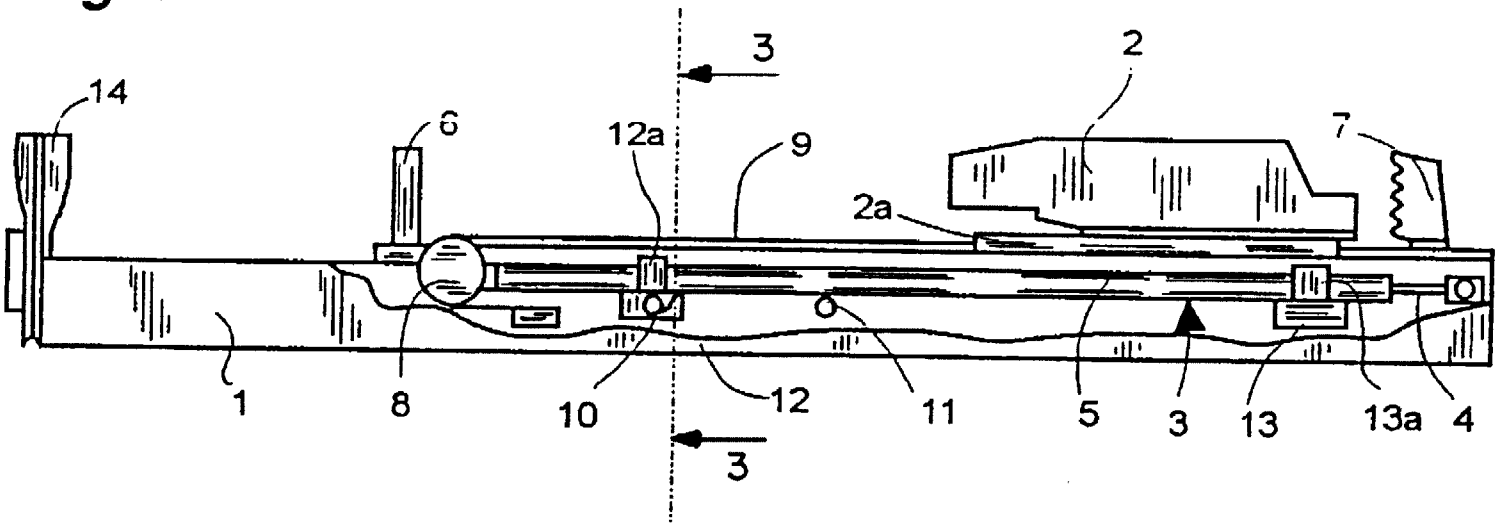

Fig. 3
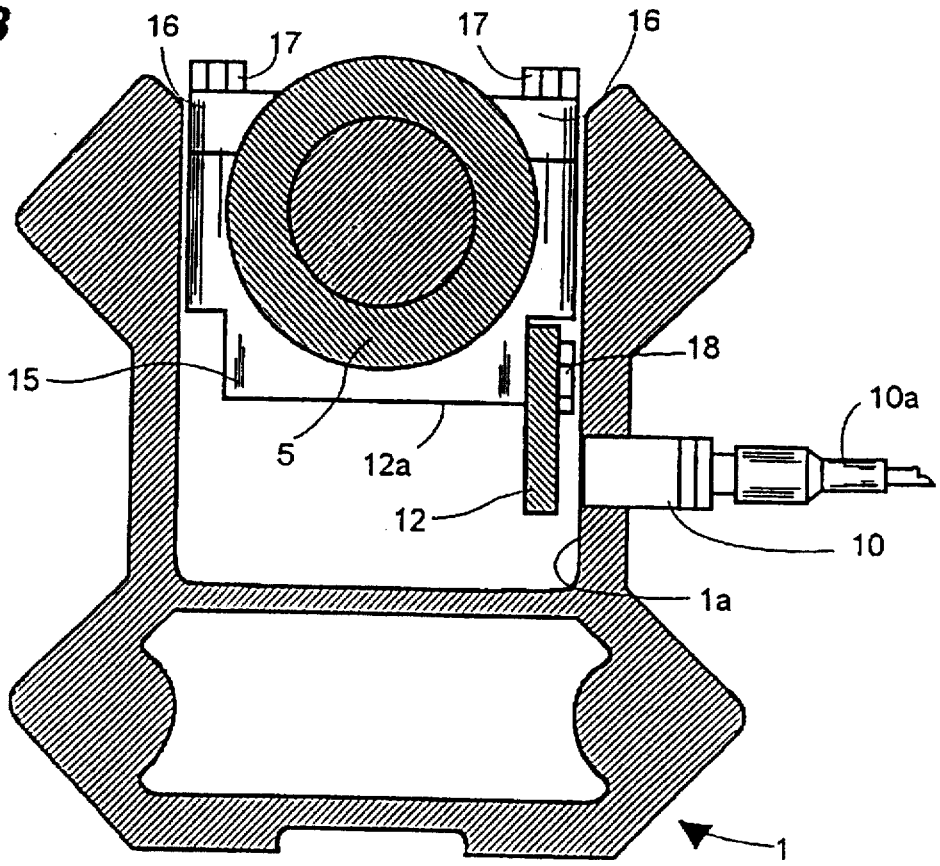
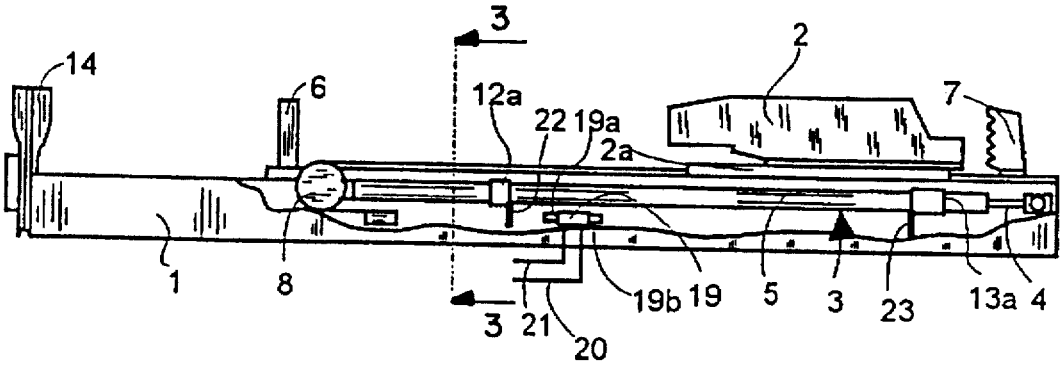
Fig. 4

ARRANGEMENT FOR CONTROLLING THE FEED MECHANISM OF A ROCK DRILL

The invention relates to an arrangement in the feed mechanism of a rock drill, said arrangement comprising a feed beam, a feed cylinder the piston rod of which is arranged to be stationary in the longitudinal direction of the feed beam whereas the cylinder sleeve of said feed cylinder is mobile in the longitudinal direction of the feed beam, a feed mechanism arranged to be driven by the feed cylinder for providing the feed and the return motion of the rock drill, a control mechanism for controlling the feed mechanism of the rock drill, an indicator connected so that it moves in the same direction as the rock drill for indicating the position of the rock drill, and at least one sensing element which detects the indicator when the indicator reaches a predetermined position with respect to the sensing element and supplies to the control mechanism a control signal necessary for controlling the motions of the rock drill.

At present, rock drills are controlled by various sensing elements, typically inductive or hydraulic switches. These switches are positioned outside the feed beam in separate boxes at the front and the rear end of the feed beam. The indicator or control pieces that are required for the control are attached to drill carriages moving along the feed beam in such a manner that they extend outside the feed beam. If these solutions are implemented electrically, they are rather easily broken and, in order to be able to operate, require complicated control connections. In addition, the cables needed for the connection are long and difficult to protect in use. Correspondingly, if the solutions are implemented hydraulically, the long hydraulic hoses that are required are difficult to protect and easily broken.

The object of the present invention is to provide an arrangement by which the previous drawbacks can be avoided and by which the indicators, and the sensing elements functioning with the help of them, can be easily mounted in a reliable and secure manner. A further object of the invention is to provide an arrangement in which the sensing elements are simple and easy to connect and in which short connection cables or hoses can be used. The arrangement according to the invention is characterized in that each sensing element is mounted on the feed beam of the rock drill somewhere along the travel of the cylinder sleeve, that each indicator is secured to the cylinder sleeve so as to move together with it so that when the rock drill reaches a predetermined position with respect to the feed beam, the indicator secured to the cylinder sleeve causes the corresponding sensing element to supply a control signal to the control mechanism.

An essential feature of the invention is that the sensing element or elements are mounted somewhere along the travel of the cylinder sleeve of the feed cylinder, preferably close to the centre of the feed beam, in such a manner that the sensing area extends inside the feed beam and the sensing elements are well protected against external effects. It is another essential feature of the invention that the indicators are secured to the cylinder sleeve of the feed cylinder so that when the cylinder sleeve is moving, they can activate the sensing elements and thus control the feed and the return motion.

An advantage of the invention is that the sensing elements are positioned within the feed beam, in the centre of it, well protected against external effects, such as falling stones. Another advantage of the invention is that the control cables or hoses are short, and it is relatively easy to mount them so that they are protected. In addition, it is easy and simple to adjust the limits of the arrangement, as the indicators can be easily displaced along the cylinder sleeve of the feed cylinder. Thus it is easy to provide accurate control.

Figure 2:
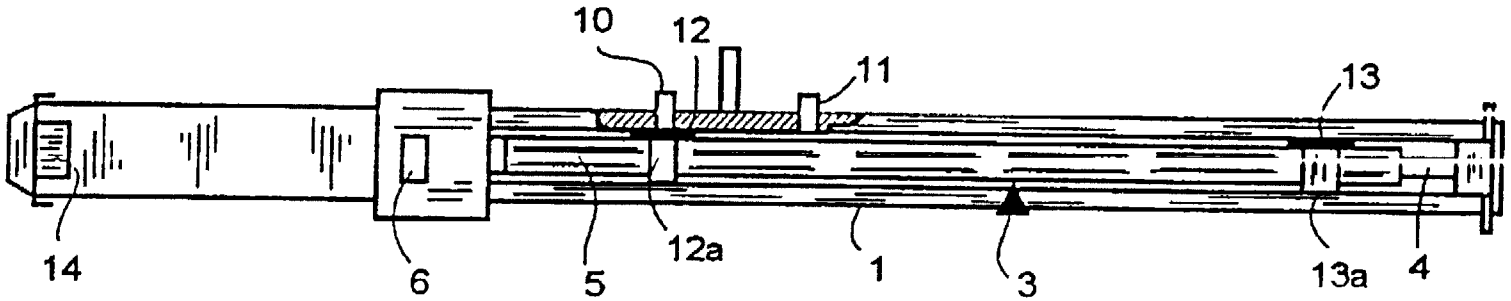

In the following, the invention will be described in greater detail with reference to the accompanying drawings, in which FIG. 1 is a schematic, partly sectional side view of the arrangement according to the invention, FIG. 2 is a schematic top view of the arrangement of FIG. 1, FIG. 3 is a schematic, cross-sectional rear view of the arrangement of FIG. 1, taken along the line A—A, FIG. 4 is a schematic view of the arrangement according to the invention when implemented hydraulically.

FIG. 1 is a schematic view of the feed beam 1 of a rock drill 2, which, secured to a carriage 2*a*, moves along the feed beam. The centre of the feed beam 1 is provided with a feed cylinder 3, the piston rod 4 of which is connected at one end to the feed beam 1. The piston is located inside the cylinder sleeve 5 of the feed cylinder 3, wherefore the cylinder sleeve 5 can move in different directions with respect to the feed beam 1 while pressure medium is supplied to different sides of the piston. The structure and operation of the feed cylinder 3 are generally known per se and therefore will not be described more closely herein.

FIG. 1 shows a travelling centralizer 6, which also moves along the feed beam 1. A hose reel 7 is partially shown at the rear end of the feed beam. A pulley 8 is connected to the front end of the feed cylinder 3. A feed wire 9, one end of which is connected to the feed beam 1, runs around the pulley 8 and is arranged to displace the drill 2 while the cylinder sleeve 5 of the feed cylinder moves in the longitudinal direction of the feed beam 1. The feed mechanism comprising a feed cylinder 3, a pulley 8 and a feed wire 9 is generally known per se and obvious to one skilled in the art, wherefore it will not be described in greater detail herein.

While the feed cylinder 3 operates, the cylinder sleeve 5 moves, on account of the feed mechanism, in a certain relation to the motion of the drill 2, i.e. the motion of the cylinder sleeve 5 is only half of the motion of the drill 2. However, the position of the cylinder sleeve 5 is constantly accurately defined with respect to the position of the drill 2; thus the cylinder sleeve 5 can be used for indicating the position of the drill and thereby to control the feed and the return motion of the drill 2. Sensing elements are mounted in the middle of the lateral wall of the feed beam 1 in such a manner that they extend inside the feed beam 1. In the case of electrical control, the sensing elements are usually inductive sensors 10 and 11, which react when metal enters their sensing area. For such control, indicators 12 and 13 are attached to the cylinder sleeve 5 by brackets 12*a* and 13*a* which are detachable and displaceable in the longitudinal direction of the cylinder sleeve 5 for determining the correct connection position. The indicators 12 and 13 are preferably indicator plates made of steel or some other suitable metal which is effectively detected by the inductive sensors. The front end of the feed beam 1 is provided with a drill steel centralizer 14, through which the drill steel (not shown) travels.

FIG. 2 shows the arrangement of FIG. 1 seen from above. For reasons of clarity, the drill 2 and the carriage 2*a* are not shown. As can be seen from FIG. 2, the inductive sensors 10 and 11, which function as sensing elements, are mounted on the lateral wall of the feed beam 1 in such a manner that they extend approximately to the inner surface of the feed beam.

The indicators 12 and 13 move inside the feed beam 1 together with the cylinder sleeve 5 close to that part of the inner surface of the feed beam 1 where the sensors are positioned. When the indicator 12, which is closer to the front end of the feed beam, is in alignment with inductive sensor 10, it indicates that the cylinder sleeve 5 and the drill 2 have reached the rearmost position with respect to the feed beam 1. Correspondingly, when the drill 2 moves forward along the feed cylinder 3, the indicator 13 at the rear end of the feed beam moves forward, and when it is in alignment with the inductive sensor 11 closer to the rear end of the feed beam, it indicates that the cylinder sleeve 5 and thus the drill 2 have reached the foremost position with respect to the feed beam 1. These electrically produced indication signals thus control the feed and the return motion of the drill 2 and stop them at a suitable location at the front and the rear end of the feed beam 1. Instead of two inductive sensors, it is also possible to use one inductive sensor and two indicators. In this case, both of the indicators cause the inductive sensor to indicate the extreme position. Whether the cylinder has reached the front or the rear position is found out, for instance, on the basis of the direction in which the feed cylinder is moving.

FIG. 3 schematically illustrates the position and mounting of the inductive sensor 10 and the indicator 12 with respect to the feed beam 1 as a cross-section taken along the line A—A of FIG. 1. As can be seen from FIG. 3, the inductive sensor 10, comprising a sensor cable 10*a*, is positioned at about the middle of the feed beam in the vertical direction and extends approximately to the inner surface 1*a* of the feed beam 1. The indicator 12 is secured to a bracket 12*a*, consisting of a body 15, key elements 16 and securing bolts 17. The indicator 12 is secured to the body 15 by means of a screw or a bolt 18. The bracket shown in the figure is very easy to mount on the cylinder sleeve 5, as the body 15 can be pushed around the cylinder sleeve 5, whereafter the key elements 16 can be tightened by the bolts 17 so that the bracket 12*a* and along with it even the indicator 12 are stationary in relation to the cylinder sleeve 5 in the longitudinal direction of the sleeve. The bracket 13*a* and the indicator 13 secured to it, shown in FIGS. 1 and 2, are constructed in the same manner. Likewise, inductive sensor 11 is mounted in the same manner as inductive sensor 10 in FIG. 3.

FIG. 4 illustrates an arrangement according to the invention when the sensing element used is a hydraulic impulse cylinder. An impulse cylinder comprises typically a spring-loaded piston; both ends of the piston rod are provided with an impulse peg which projects out of the impulse cylinder by the action of a spring. When a certain object, such as an indicator plate or a corresponding surface indicating a certain position, hits one of the impulse pegs, the peg pushes the piston within the impulse cylinder and causes the hydraulic fluid to flow out of the impulse cylinder, whereby the control mechanism connected to the impulse cylinder reacts to the pressure pulse formed. In a double-action impulse cylinder, the piston is spring-loadedly positioned in the middle of the impulse cylinder in the longitudinal direction of the cylinder. Both ends of the piston are provided with impulse pegs extending out of the impulse cylinder at both ends. Motions from both directions can thus be detected by the same impulse cylinder, for instance by connecting separate pressure channels to the control mechanism from each end of the piston. Impulse cylinders and their structure are generally known per se, wherefore they will not be described more closely herein. In the case illustrated in FIG. 4, the impulse cylinder 19 is mounted preferably in the middle of the travel of the cylinder sleeve 5, and it is connected to a control mechanism known per se (not shown) through impulse channels 20 and 21 containing hydraulic fluid. Indicators, in this case impulse plates 22 and 23, are secured to the cylinder sleeve 5 by brackets corresponding to the bracket 12*a* of FIG. 3. When the cylinder sleeve 5 moves to the right in FIG. 4, impulse plate 22 hits the left impulse peg 19*a* of the impulse cylinder 19, causing a pressure pulse in the first impulse channel 20, as a result of which the above-mentioned control mechanism known per se (not shown) stops the motion of the feed cylinder 3 and thus also the motion of the drill 2. Correspondingly, when the feed cylinder 5 moves to the left in the figure, the second impulse plate 23 hits the second impulse peg 19*b* of the impulse cylinder 19, as a result of which a pressure pulse is generated in the second impulse channel 21. The pressure pulse controls the control mechanism (not shown) in a similar manner and stops the supply of pressure fluid to the feed cylinder 3 and thus the motion of the cylinder sleeve 5 and also of the drill 2. Instead of a double-action impulse cylinder, it is naturally also possible, without departing from the spirit of the invention, to employ two separate single-action impulse cylinders mounted in a similar manner so that each of them detects motions from its own direction.

The invention is described above and shown in the drawings merely by way of an example, and it is in no way limited to the example. In an electrical connection, the sensing elements can be mounted not only on the lateral wall of the feed beam but also on the bottom of the beam. The indicators 12 and 13 or the impulse plates 22 and 23 can be secured to the cylinder sleeve 5 not only by brackets 12*a* of FIG. 3 but also in some other way; however, preferably in such a way that it is simple and easy to displace them in the longitudinal direction of the cylinder sleeve 5.

I claim:

1. An arrangement in the feed mechanism of a rock drill, said arrangement comprising a feed beam, a feed cylinder including a piston rod which is arranged to be stationary in the longitudinal direction of the feed beam and a cylinder sleeve which is mobile in the longitudinal direction of the feed beam, a feed mechanism arranged to be driven by the feed cylinder for providing feed and return motion of the rock drill, a control mechanism for controlling the feed mechanism of the rock drill, an indicator connected so that it moves in the same direction as the rock drill for indicating the position of the rock drill, and at least one sensing element which detects the indicator when the indicator reaches a predetermined position with respect to the sensing element and supplies to the control mechanism a control signal necessary for controlling the motions of the rock drill, wherein said at least one sensing element is mounted on the feed beam of the rock drill along the travel of the cylinder sleeve in such a manner that a sensing area of the sensing element extends inside the feed beam, and further wherein said indicator is secured to the cylinder sleeve inside the feed beam so as to move together with said cylinder sleeve, so that when the rock drill reaches a predetermined position with respect to the feed beam, the indicator secured to the cylinder sleeve causes the corresponding sensing element to supply a control signal to the control mechanism.

2. An arrangement according to claim 1, wherein said at least one sensing element comprises a plurality of inductive sensors mounted along the travel of the cylinder sleeve at a distance from each other, and wherein the cylinder sleeve is provided with a pair of indicators positioned at a distance from each other in such a manner that one of the inductive sensors closer to the front end of the feed beam indicates the rearmost position of the rock drill when one of the pair of indicators positioned closer to the front end of the feed beam is in alignment with said one sensor, and correspondingly, another of the inductive sensors closer to the rear end on the feed beam indicates the foremost position of the rock drill when the other of the pair of indicators positioned closer to the rear end of the feed beam is in alignment with said another sensor.

3. An arrangement according to claim 1, wherein said at least one sensing element is an impulse cylinder, and two impulse plates are secured to the cylinder sleeve of the feed cylinder, whereby that impulse plate which is secured to the end of the cylinder sleeve which is closer to the front end of the feed beam, upon hitting an impulse peg of the impulse cylinder which faces said impulse plate, generates a pressure pulse in the first impulse channel of the impulse cylinder, indicating a rearmost position of the rock drill, and correspondingly, that another impulse plate which is positioned at the end of the cylinder sleeve which is closer to the rear end of the feed beam, upon hitting another impulse peg of the impulse cylinder which faces said another impulse plate, generates a pressure pulse in the second impulse channel of the impulse cylinder, indicating a foremost position of the rock drill.

4. An arrangement according to claim 1, wherein said indicator comprises a plurality of indicators mounted on the cylinder sleeve for movement with said cylinder sleeve.

5. An arrangement according to claim 1, wherein the feed cylinder is in the center of the feed beam, and wherein said at least one sensing element is mounted in such a manner as to extend inside the feed beam.

* * * * *